US010849379B2

(12) United States Patent
Vigil

(10) Patent No.: US 10,849,379 B2
(45) Date of Patent: Dec. 1, 2020

(54) SHIRT COLLAR ATTACHMENT

(71) Applicant: Paul Vigil, Johnstown, CO (US)

(72) Inventor: Paul Vigil, Johnstown, CO (US)

( * ) Notice: Subject to any disclaimer, the term of this patent is extended or adjusted under 35 U.S.C. 154(b) by 0 days.

(21) Appl. No.: 16/113,958

(22) Filed: Aug. 27, 2018

(65) Prior Publication Data

US 2020/0060363 A1 Feb. 27, 2020

(51) Int. Cl.
*A41D 25/00* (2006.01)
*A41D 27/08* (2006.01)
*A41D 25/02* (2006.01)

(52) U.S. Cl.
CPC ..... *A41D 25/003* (2013.01); *A41D 25/02* (2013.01); *A41D 27/08* (2013.01)

(58) Field of Classification Search
CPC ..... A41D 25/003; A41D 25/02; A41D 28/08
USPC ..... 2/144, 145, 157, 152.1, 148, 149, 146, 2/130, 137, 129, 116
See application file for complete search history.

(56) References Cited

U.S. PATENT DOCUMENTS 2,688,136 A * 9/1954 Freedman ..... A41D 1/22 2/105
4,343,045 A * 8/1982 Ferrari ..... A41D 23/00 2/92
5,010,589 A * 4/1991 Hamilton ..... A41D 13/00 2/1
5,036,550 A * 8/1991 Wilsey ..... A41D 25/005 2/144
5,416,928 A * 5/1995 Koenig ..... A41D 27/08 2/105
5,513,392 A * 5/1996 Douglas ..... A41D 23/00 2/207
6,408,438 B1 * 6/2002 McKee ..... A41D 15/002 2/244
2004/0142630 A1 * 7/2004 Lambru ..... A41C 3/005 450/1
2014/0298563 A1 * 10/2014 Cavero ..... A41D 15/00 2/74
2016/0000156 A1 * 1/2016 Barnyak ..... A41D 15/00 2/69

* cited by examiner

*Primary Examiner* — Gloria M Hale

(57) ABSTRACT

A shirt collar attachment includes a first support, a second support, at least one design body, a first collar attachment, and a second collar attachment. The first support and the second support are terminally connected to each other at an angle, wherein the angle can be an acute, right, or obtuse angle. The at least one design body is adjacently connected to the first support and the second support thus providing the design element for the shirt collar attachment. The first collar attachment is terminally connected to the first support, opposite of the second support. The second collar attachment is terminally connected to the second support, opposite of the first support. Collectively, the first collar attachment and second collar attachment are able to secure the shirt collar attachment to the corners of the shirt collar, providing an alternative to necktie and variants neckwear.

7 Claims, 7 Drawing Sheets

DETAIL A

DETAIL B

SHIRT COLLAR ATTACHMENT

FIELD OF THE INVENTION

The present invention relates generally to a fashionable neckwear. More specifically, the present invention is a fashionable shirt collar attachment that is designed to be alternative to a tie, bowtie, or bolo tie.

BACKGROUND OF THE INVENTION

Neckties and variants neckwear (e.g. ascot tie, bow tie, bolo tie) are generally utilized for decorative purpose around the neck, resting under the shirt collar. The necktie and variants neckwear can also be recognized as a part of formal wear or part of uniform (e.g. military, office, school). Specific design for the neckties and variants neckwear have been changed throughout the history upon different fashionable movements. Furthermore, necktie is associated with many different knots (e.g. half Windsor knot, full Windsor knot, oriental knot, bow-tie knot) in order to characterize different fashionable appearances. However, the general concept of the necktie and variants neckwear have not been changed to accommodate the growing demand of different fashionable statements.

It is therefore an objective of the preset invention to provide a fashionable neckwear that is designed to be an alternative to necktie and variants neckwear. More specifically, the present invention is a fashionable neckwear jewelry that is secured to the shirt collar thus bridging the gap between the corners of the shirt collar. The present invention is secured to each corner of the shirt collar through attachment mechanisms so that the user can easily wear or remove the fashionable shirt collar attachment.

DETAIL DESCRIPTIONS OF THE INVENTION

All illustrations of the drawings are for the purpose of describing selected versions of the present invention and are not intended to limit the scope of the present invention.

Figure 1:
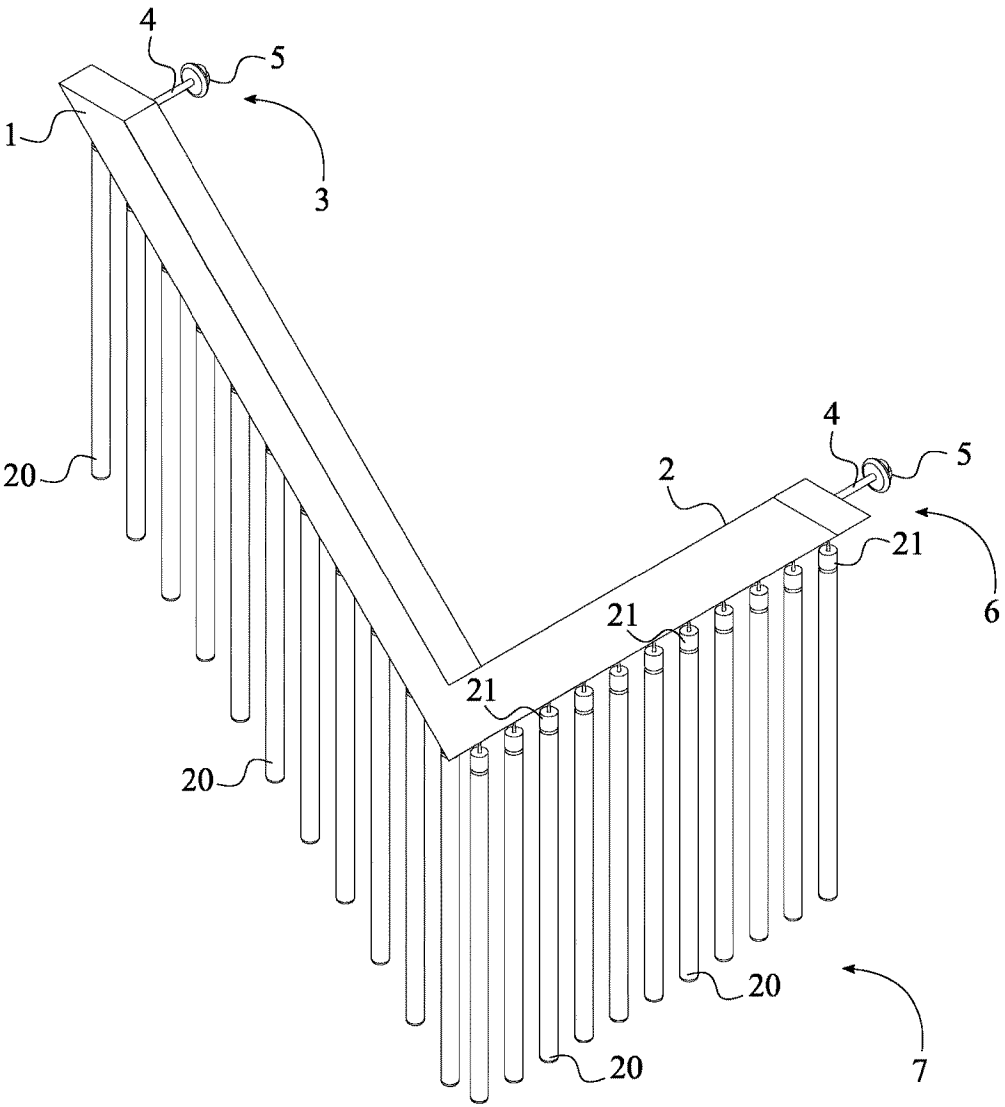
FIG. 1 is a front perspective view for the first embodiment of the present invention.
Figure 4:
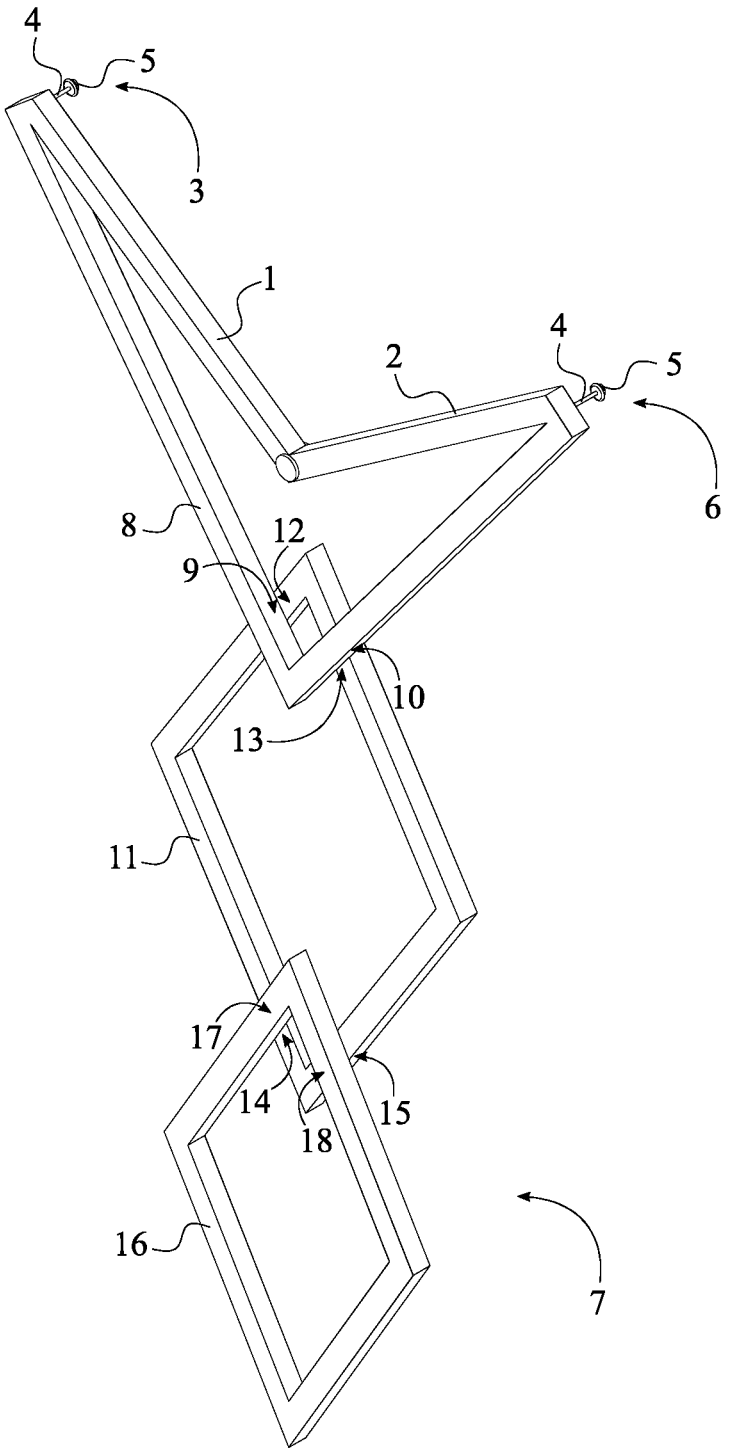
FIG. 4 is a front perspective view for the second embodiment of the present invention.

The present invention is a shirt collar attachment that bridges the gap between the corners of the shirt collar. In other words, the present invention is a fashionable neckwear jewelry that provides alternative to necktie and variants neckwear. The present invention comprises a first support 1, a second support 2, at least one design body 7, a first collar attachment 3, and a second collar attachment 6 as shown in FIG. 1 and FIG. 4. In reference to the general configuration of the present invention, the first support 1 is terminally connected to the second support 2 at an angle 22 so that the first support 1 and the second support 2 are able to create a body that bridges the corners of the shirt collar. The at least one design body 7, which functions as the design element, is adjacently connected to the first support 1 and the second support 2. The first collar attachment 3 is terminally connected to the first support 1, opposite of the second support 2, thus securing the first support 1 to one of the corners of shirt collar. The second collar attachment 6 is terminally connected to the second support 2, opposite of the first support 1, so that the second attachment is able to secure the second support 2 to the opposite corner of the shirt collar.

Figure 3:
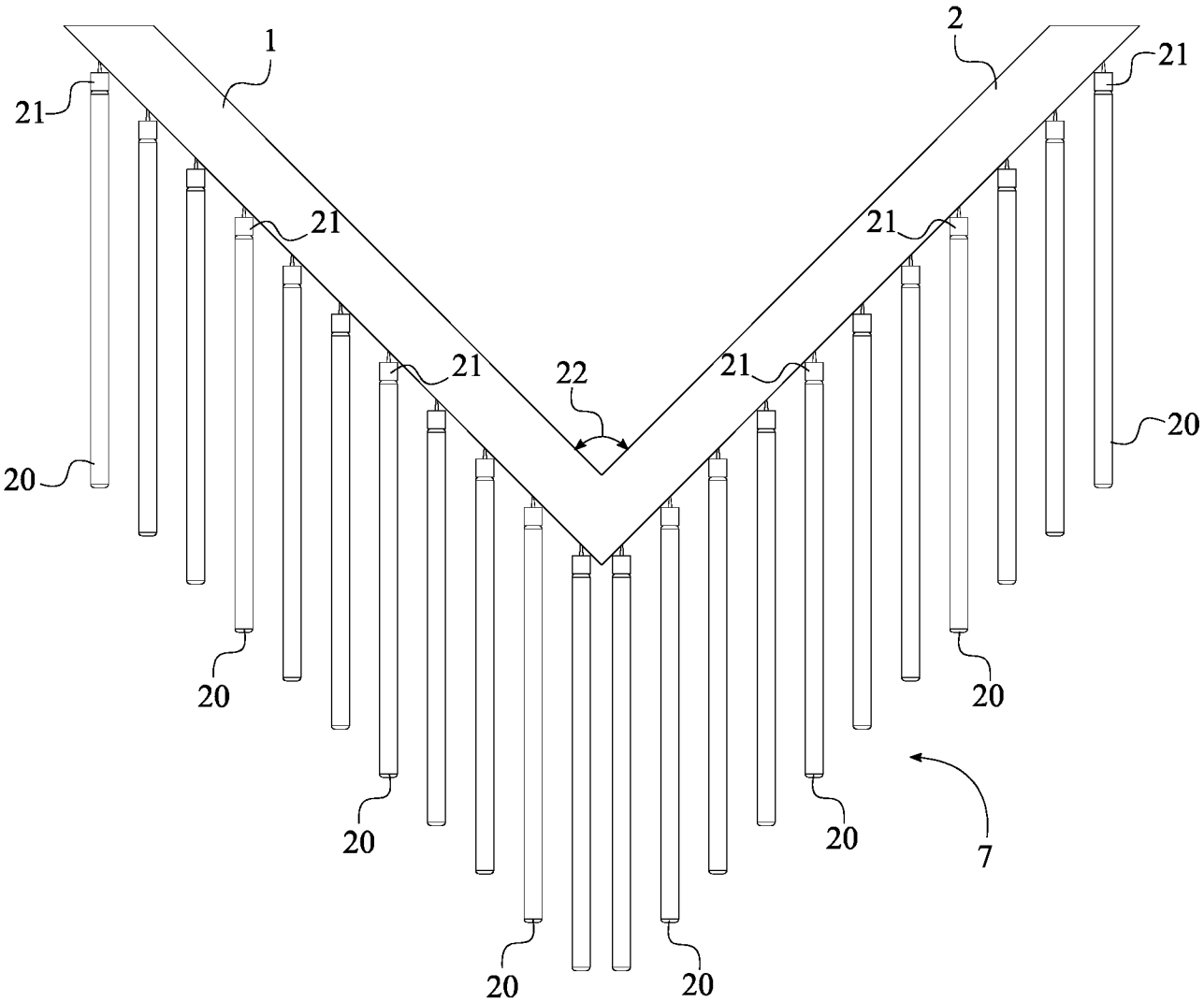
FIG. 3 is a front view for the first embodiment of the present invention.
Figure 8:
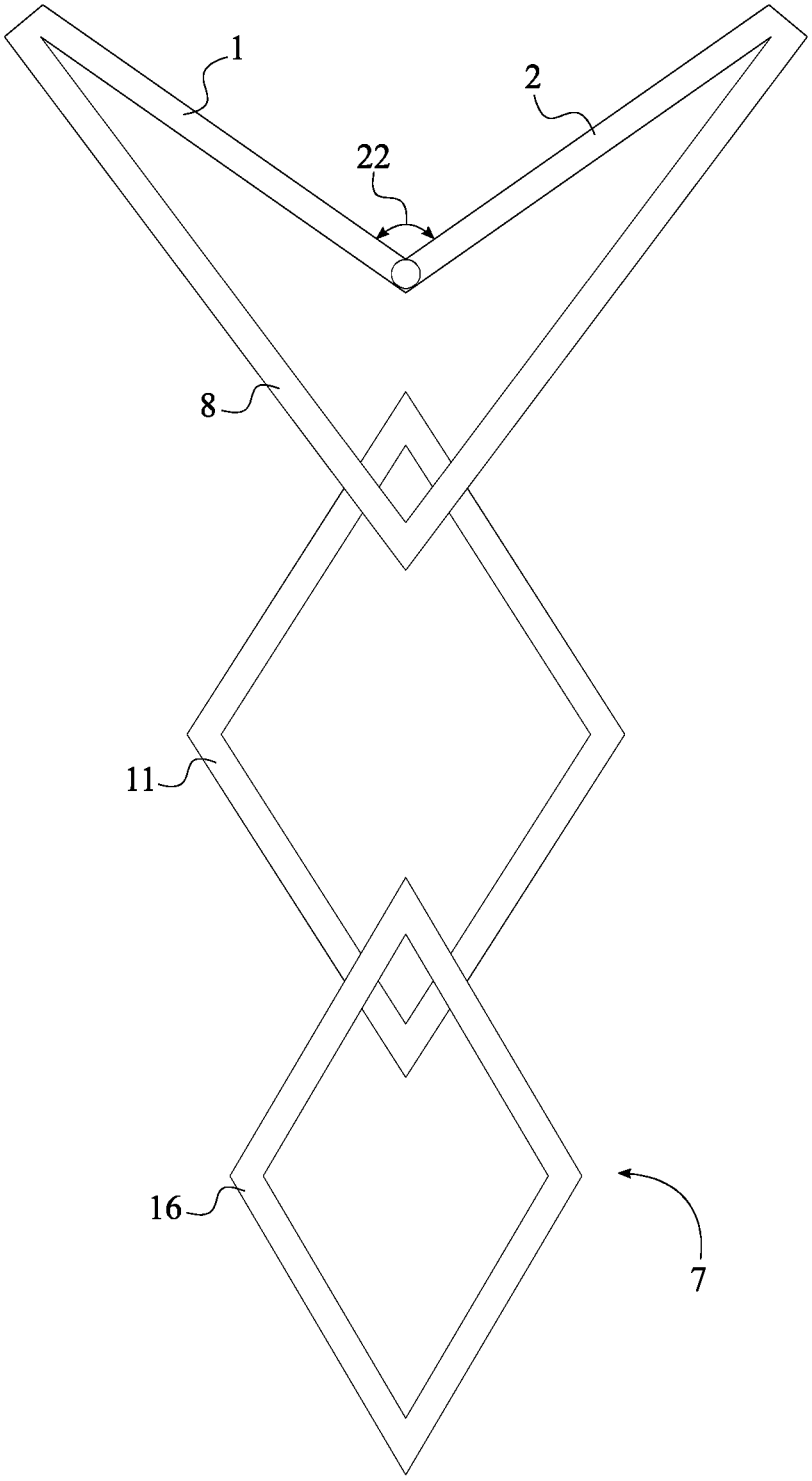
FIG. 8 is a front view for the first embodiment of the present invention.

In reference to FIG. 3 and FIG. 8, the first support 1 and the second support 2 are elongated member that resembles a V-shaped collar bridging member so that the first support 1 and the second support 2 can bridge the corners of the shirt collar. The angle 22 between the first support 1 and the second support 2 determine the actual form of the V-shaped collar bridging member as the angle 22 can be an acute angle, a right angle, or an obtuse angle.

In reference to FIG. 2 and FIG. 5-7, the first collar attachment 3 and the second collar attachment 6 each comprises a pin 4 and a pin back 5 as the first collar attachment 3 and the second collar attachment 6 secure the present invention to the corner of the shirt collar. More specifically, the pin 4 of the first collar attachment 3 is connected to the first support 1. The pin 4 of the second collar attachment 6 is connected to the second support 2. Additionally, the pin 4 for the first collar attachment 3 and the pin 4 for the second collar attachment 6 are extended towards the back side of the present invention so that both pins 4 can engage or traverse through the corners of the shirt collar. The pin back 5 is concentrically positioned to the pin 4 so that the pin back 5 can be slidably attached to the pin 4. Resultantly, the pin back 5 of the first collar attachment 3 positions behind shirt collar and engages with the pin 4 of the first collar attachment 3 thus securing the first support 1 to the shirt collar. The pin back 5 of the second collar attachment 6 positions behind shirt collar and engages with the pin 4 of the second collar attachment 6 thus securing the second support 2 to the shirt collar. Even though the pin 4 and the pin back 5 are the preferred fastening mechanism for the first collar attachment 3 and the second collar attachment 6, the present invention can utilize any other types of similar fastening mechanism such as magnetic fasteners and clip fasteners.

Figure 2:
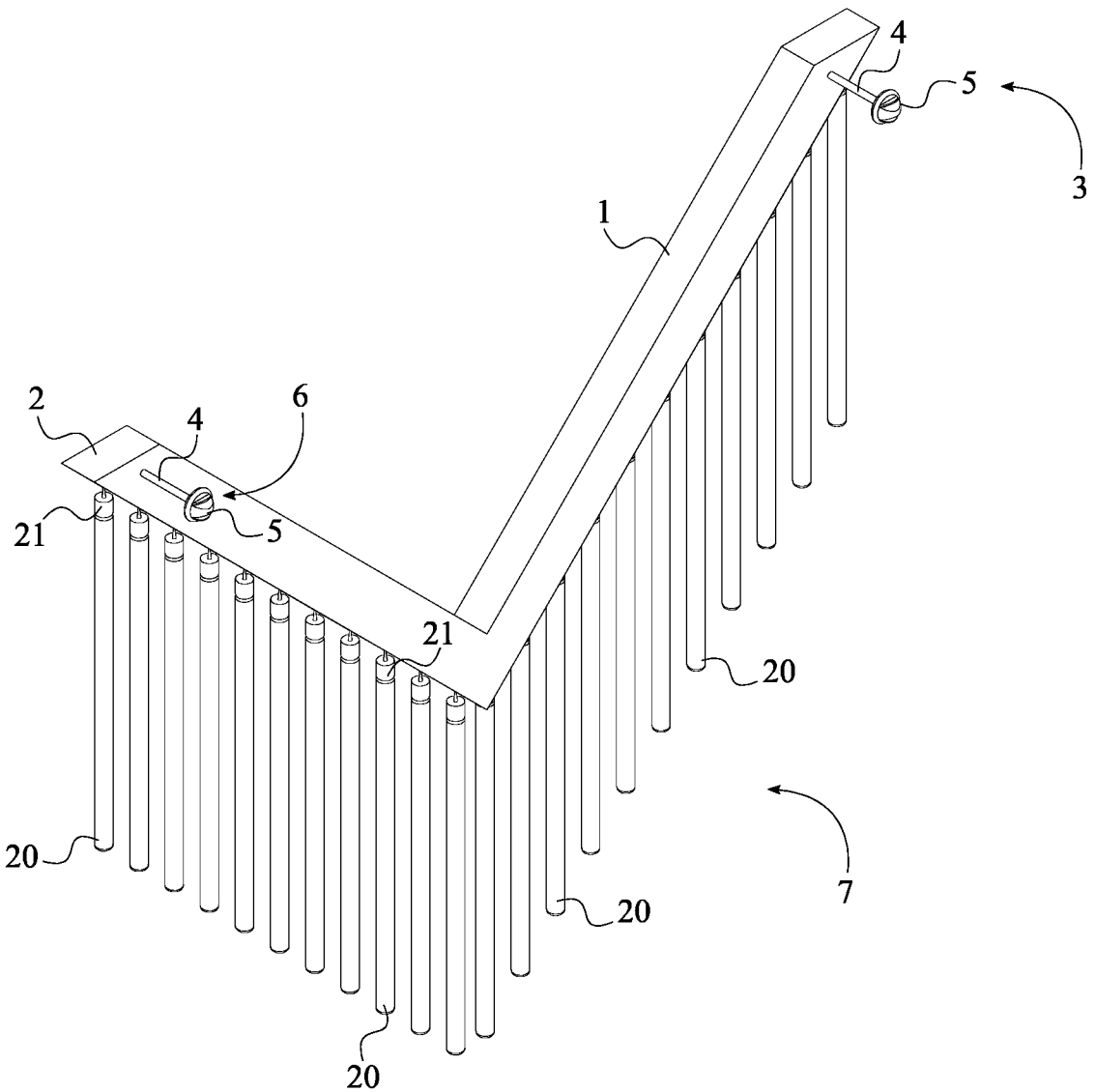
FIG. 2 is a rear perspective view for the first embodiment of the present invention.

In reference to a first embodiment of the present invention, the at least one design body 7 comprises a plurality of threads 20 and a plurality of thread attachments 21 as shown in FIG. 1-3. The plurality of thread attachments 21 is evenly distributed along the first support 1 and the second support 2 so that the plurality of threads 20 can be adjacently connected to the plurality of thread attachments 21. Resultantly, each of the plurality of threads 20 is secured to the first support 1 and the second support 2 through the each of the plurality of thread attachments 21. Additionally, each of the plurality of thread attachments 21 can provide a fixed attachment or a flexible attachment to the each of the plurality of threads 20 delineating different design configurations for the first embodiment of the present invention.

In reference to a second embodiment of the present invention, the at least one design body 7 comprises a proximal chevron section 8, at least one intermediate diamond section 11, and a distal diamond section 16 as shown in FIG. 4-8. The proximal chevron section 8, the at least one intermediate diamond section 11, and the distal diamond section 16 are linearly connected to each other below the first support 1 and the second support 2 forming the design profile for the second embodiment of the present invention.

In reference to FIG. 8, the proximal chevron section 8, which is formed into a V-member, is terminally connected to the first support 1 and the second support 2. More specifically, a first end of the proximal chevron is terminally connected to the first support 1 about the first collar attachment 3. A second end of the proximal chevron is terminally connected to the second support 2 about the second collar attachment 6.

Figure 5:
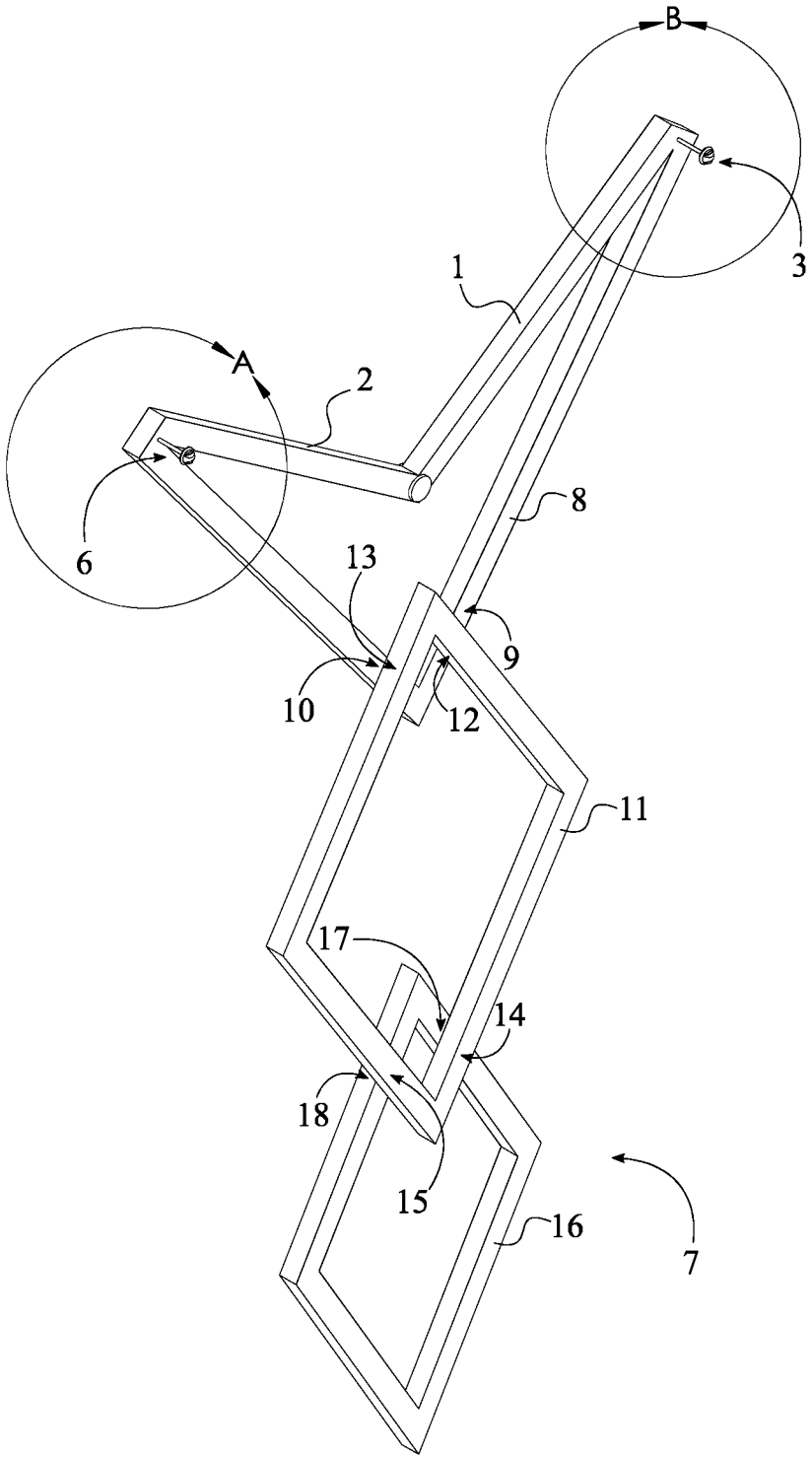
FIG. 5 is a rear perspective view for the second embodiment of the present invention, showing the sections which, a detailed view is taken shown in FIG. 6 and FIG. 7.
Figure 6:
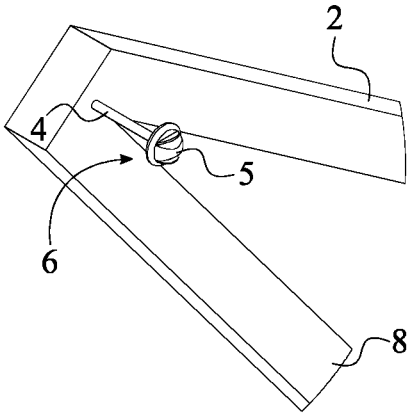
FIG. 6 is a detailed view for the second embodiment of the present invention taken within section line A.
Figure 7:
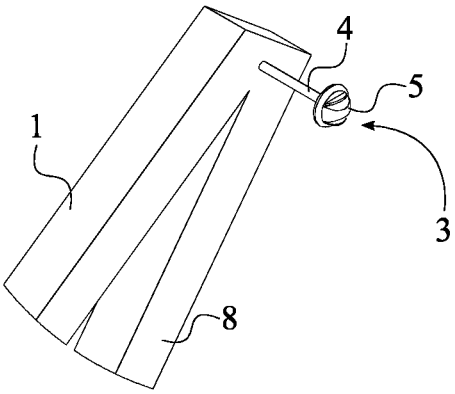
FIG. 7 is a detailed view for the second embodiment of the present invention taken within section line B.

The at least one intermediate diamond section 11 is adjacently connected to the proximal chevron section 8 and positioned opposite of the first support 1 and the second support 2. More specifically, the proximal chevron section 8 comprises a first intersection 9 and a second intersection 10 as shown in FIG. 4-5. The at least one intermediate diamond section 11 comprises a third intersection 12 and a fourth intersection 13 as shown in FIG. 4-5. The proximal chevron section 8 and the at least one intermediate diamond section 11 are adjacently connected to each other by the first intersection 9 and the third intersection 12, wherein the first intersection 9 and the third intersection 12 are adjacently positioned to the first support 1. Additionally, the proximal chevron section 8 and the at least one intermediate diamond section 11 are adjacently connected to each other by the second intersection 10 and the fourth intersection 13 as the second intersection 10 and the fourth intersection 13 are adjacently positioned to the second support 2.

The distal diamond section 16 is adjacently connected to the at least one intermediate diamond section 11 and positioned opposite of the proximal chevron section 8. More specifically, the distal diamond section 16 comprises a seventh intersection 17 and an eighth intersection 18 as shown in FIG. 4-5. The at least one intermediate diamond section 11 further comprises a fifth intersection 14 and a sixth intersection 15 as shown in FIG. 4-5. The distal diamond section 16 and the at least one intermediate diamond section 11 are adjacently connected to each other by the fifth intersection 14 and the seventh intersection 17, wherein the fifth intersection 14 and the seventh intersection 17 are adjacently positioned to the first support 1. The distal diamond section 16 and the at least one intermediate diamond section 11 are adjacently connected to each other by the sixth intersection 15 and the eighth intersection 18 as the sixth intersection 15 and the eighth intersection 18 are adjacently positioned to the second support 2.

Although the invention has been explained in relation to its preferred embodiment, it is to be understood that many other possible modifications and variations can be made without departing from the spirit and scope of the invention as hereinafter claimed.

What is claimed is:

1. A neckwear comprising:
- a first support;
- a second support;
- at least one design body;
- a first attachment;
- a second attachment;
- the first support being terminally connected to the second support at an angle;
- the at least one design body being connected to the first support and the second support;
- the first attachment being terminally connected to the first support, opposite of the second support;
- the second attachment being terminally connected to the second support, opposite of the first support;
- the first attachment and the second attachment each comprising a pin and a pin back;
- the pin of the first attachment being connected to the first support;
- the pin of the second attachment being connected to the second support;
- the pin back being concentrically positioned to the pin; and
- the pin back being slidably attached to the pin.

2. The neckwear as claimed in claim 1 comprising:
- the at least one design body comprising a proximal section, at least one intermediate section, and a distal section;
- the proximal section having a V shape;
- the at least one intermediate section and the distal section each having a diamond shape;
- the proximal section being terminally connected to the first support and the second support;
- the at least one intermediate section being connected to the proximal section, opposite of the first support and the second support; and
- the distal section being connected to the at least one intermediate section, opposite of the proximal section.

3. The neckwear as claimed in claim 2 comprising:
- the proximal section comprising a first intersection and a second intersection;
- the at least one intermediate section comprising a third intersection and a fourth intersection;
- the proximal section and the at least one intermediate section being connected to each other by the first intersection and the third intersection;
- the first intersection and the third intersection being adjacently positioned to the first support;
- the proximal section and the at least one intermediate section being connected to each other by the second intersection and the fourth intersection; and
- the second intersection and the fourth intersection being adjacently positioned to the second support.

4. The neckwear as claimed in claim 2 comprising:
- the distal section comprising a seventh intersection and an eighth intersection;
- the at least one intermediate section comprising a fifth intersection and a sixth intersection;
- the distal section and the at least one intermediate section being connected to each other by the fifth intersection and the seventh intersection;
- the fifth intersection and the seventh intersection being adjacently positioned to the first support;
- the distal section and the at least one intermediate section being connected to each other by the sixth intersection and the eighth intersection; and
- the sixth intersection and the eighth intersection being adjacently positioned to the second support.

5. The neckwear as claimed in claim 1, wherein the angle between the first support and the second support is an acute angle.

6. The neckwear as claimed in claim 1, wherein the angle between the first support and the second support is a right angle.

7. The neckwear as claimed in claim 1, wherein the angle between the first support and the second support is an obtuse angle.

* * * * *